US012559204B2

(12) United States Patent
Hawkes et al.

(10) Patent No.: US 12,559,204 B2
(45) Date of Patent: Feb. 24, 2026

(54) SCUPPER PLUG FOR A PERSONAL WATERCRAFT

(71) Applicant: Patrick Industries, Inc., Elkhart, IN (US)

(72) Inventors: Jed Hawkes, Everett, WA (US); Paul Masato Furrer, Everett, WA (US); Paul Olliges, Everett, WA (US)

(73) Assignee: Patrick Industries, Inc., Elkhart, IN (US)

( * ) Notice: Subject to any disclaimer, the term of this patent is extended or adjusted under 35 U.S.C. 154(b) by 417 days.

(21) Appl. No.: 18/348,251

(22) Filed: Jul. 6, 2023

(65) Prior Publication Data

US 2025/0010949 A1 Jan. 9, 2025

(51) Int. Cl.
*B63B 13/00* (2006.01)

(52) U.S. Cl.
CPC ..... *B63B 13/00* (2013.01)

(58) Field of Classification Search
CPC .... B63B 13/00; B63B 2013/005; B63B 13/02
USPC ..... 114/182, 183 R; 52/302.7; 49/406, 408
See application file for complete search history.

(56) References Cited

U.S. PATENT DOCUMENTS

| | | | | |
|---|---|---|---|---|
| 2,204,400 | A * | 6/1940 | Ernest | B63B 13/00 114/182 |
| 6,615,760 | B1 * | 9/2003 | Wise | F16K 15/04 114/197 |
| 6,754,915 | B2 * | 6/2004 | Mistarz | E04H 4/1218 4/507 |
| 8,763,548 | B2 * | 7/2014 | Swetish | B63B 13/00 114/182 |
| 12,110,080 | B2 * | 10/2024 | Marsh | B63B 34/21 |

* cited by examiner

*Primary Examiner* — Daniel V Venne
(74) *Attorney, Agent, or Firm* — Christensen O'Connor Johnson Kindness PLLC

(57) ABSTRACT

A scupper plug for selectively sealing a scupper hole is provided. The scupper plug can include a tapered sealing surface and one or more legs extending from the tapered sealing surface. The legs can include tapered retention surfaces positioned at a distal portion of the legs, and stopping shoulders adjacent to the tapered retention surfaces. The scupper plug can have a central cavity extending between the first and second legs and defining first and second cutouts extending through the first and second legs. When in a closed position, the tapered sealing surface can be positioned to sealingly contact a scupper surface in the scupper hole to prevent water flow through the scupper hole, and when in an open position, the tapered retention surfaces can be positioned to contact the scupper surface to retain the scupper plug in the open position to permit water flow through the scupper hole.

21 Claims, 8 Drawing Sheets

SCUPPER PLUG FOR A PERSONAL WATERCRAFT

BACKGROUND

A scupper plug is a water flow control accessory typically used for rigid personal watercraft, such as sit-on-top kayaks, that selectively controls the flow of water through scupper holes. Scupper holes can be formed in the hull of the watercraft and act as drainage points to allow water to drain out of the upper surfaces of the watercraft, such as the seating area, preventing the water from pooling in the seating area and/or making the watercraft unstable. A scupper plug can block or selectively permit the flow of water through the scupper holes.

During use, scupper plugs can be placed in a closed position to block water ingress through the scupper hole, such as while paddling in rough waters or on cold days to minimize water splashing up through the scupper holes and onto the user. In calmer waters, in the rain, and/or after taking water over the top of the watercraft (e.g., after paddling through a wave, wake, or rough water), the scupper plug can be opened to permit water drainage from the upper surfaces of the watercraft and into the water below. Additionally, scupper plugs can provide increased stability and buoyancy, as they prevent water from accumulating in the seating area.

Scupper plugs can be formed to fit snugly into the scupper hole and can have a feature for insertion and removal. These scupper plugs often are formed in different sizes to fit various scupper hole diameters. Scupper plugs are often either installed in the closed position or completely removed to allow drainage through the scupper hole. During drainage, the scupper plug must be set aside where it can be misplaced, requiring frequent replacement with new scupper plugs. Additionally, the set aside scupper plug must then be realigned with the scupper hole to prevent the flow of water, which can be difficult during use of the watercraft (e.g., in rough water conditions). Therefore, it is desirable to retain the scupper plug in the scupper hole during drainage in the open position, as well as maintain alignment with the scupper hole when transitioning between the open and closed positions. Embodiments of a scupper plug in accordance with aspects of the present disclosure provide improved control and performance as compared to known scupper plugs.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

Figure 1A:
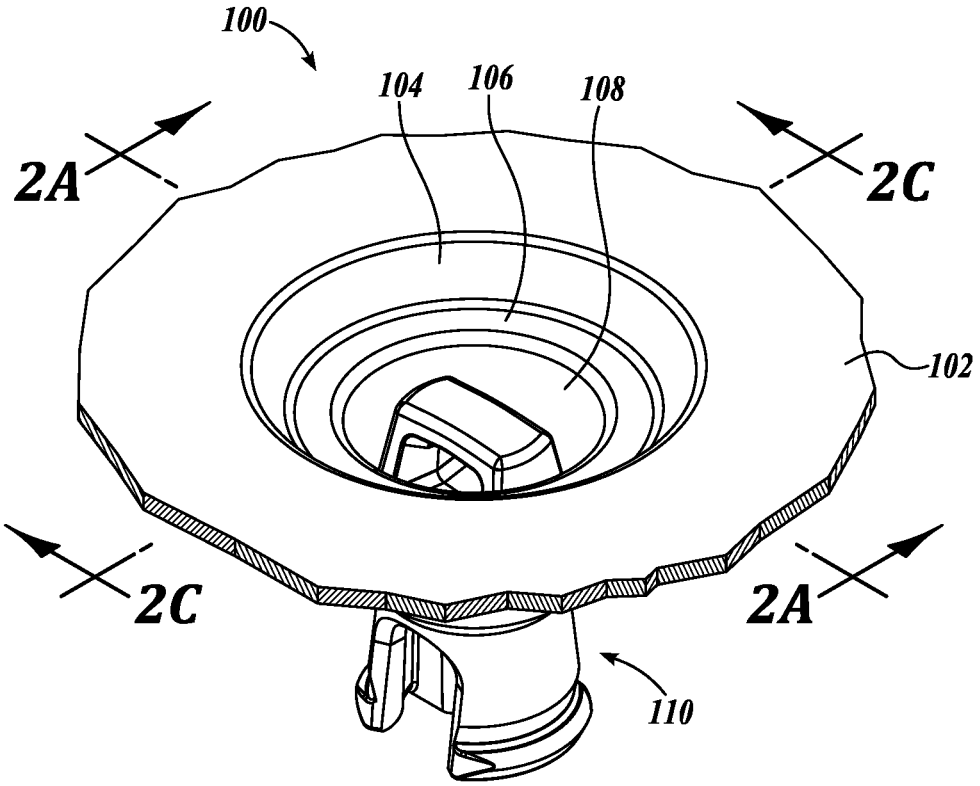
FIG. 1A depicts one example of a scupper plug assembled into a scupper hole of a scupper surround, such as a scupper hole in a personal watercraft hull, with the scupper plug and scupper surround assembly shown in perspective view and the scupper plug shown in a closed position, in which technologies and/or methodologies of the present disclosure may be employed.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed.

As will be described in more detail below, the present disclosure provides examples of a scupper plug having one or more retention features to releasably capture the scupper plug within the scupper hole in the open position-permitting the flow of water through the scupper hole. The retention features are configured to retain the scupper plug in the open position aligned with and above the scupper hole without needing to remove the scupper plug from the hole, move the scupper plug aside, or hold the scupper plug during draining. In this regard, the motion from the closed position to the open position is substantially axial along a central axis of the scupper hole. Some known scupper plugs have lanyards, chains, or leashes to keep the scupper plug near the scupper hole when draining the personal watercraft; however, such retention features can break, are not capable of maintaining alignment of the scupper plug with the scupper hole in the open position, and can allow the scupper plug to inadvertently fall into and close the scupper hole when draining is still desired. Further, these known scupper plugs must be completely removed from the scupper hole to drain, which leaves the scupper hole open for fountains of water splashing above the watercraft, especially when rougher waters where pressure differentials between the upper and lower surface of the watercraft are greatest. The scupper plugs of the present disclosure are expected to address these and other issues.

In embodiments described herein, the scupper plug has a primary taper configured to contact a tapered surface of the scupper surround, e.g., in the hull of a personal watercraft, and seal the scupper hole within the scupper surround. The scupper plug further includes a secondary taper at a distal end that interfaces with the tapered surface of the scupper surround, but includes one or more cutouts to permit the flow of water through the scupper hole while retaining the scupper plug at least partially within the scupper hole and maintaining axial alignment of the scupper plug and the scupper hole. In these embodiments, the scupper plug includes one or more legs that are capable of bending radially inward during movement of the scupper plug between the closed and open positions, and then elastically extending radially outward at the open position such that the secondary taper interfaces with the taper of the scupper plug to retain the scupper plug in the open position aligned with the scupper hole. The one or more legs can include a distal shoulder configured to interface with the scupper surround to stop axial movement of the scupper plug at the open position. In some embodiments, the distal shoulder can include a fillet to facilitate full removal of the scupper plug with additional pulling force past the open position, e.g., when replacing the scupper plug, if the scupper hole needs to be cleaned, etc. Although the illustrated embodiments show a scupper plug having two bendable legs, any number of legs are within the scope of the present disclosure, such as one leg, three legs, more than three legs, etc.

The scupper plugs of the present disclosure can include a proximal loop that can be manipulated, e.g., grasped by a finger of the user, to transition the scupper plug from the closed position to the open position and/or to remove the scupper plug from the scupper hole. The proximal loop may further include an upper surface that can receive a force, e.g., by a user pressing on the upper surface, to transition the scupper plug from the open position to the closed position and/or to install the scupper plug in the scupper hole. Although the illustrated embodiments show a proximal loop manipulable by a user, the scupper plugs of the present disclosure can include any suitable translation feature that can be manipulated by a user, such as a handle, a knob, a T-shape, a web, a ball, or the like, or can include a separate component for this purpose, such as an over-molded rigid handle (e.g., plastic, metallic, etc.), an embedded feature, or the like.

Although embodiments of the present disclosure may be described with reference to scupper plugs for rigid kayaks, one skilled in the relevant art will appreciate that the disclosed embodiments are illustrative in nature and therefore should not be construed as limited to such an application. It should therefore be apparent that the disclosed technologies and methodologies have wide application, and therefore may be suitable for use with many types of hole plugging architectures, including any personal watercraft, floating platforms, engine-propelled watercraft, and the like. Accordingly, the following descriptions and illustrations herein should not limit the scope of the claimed subject matter.

Figure 1B:
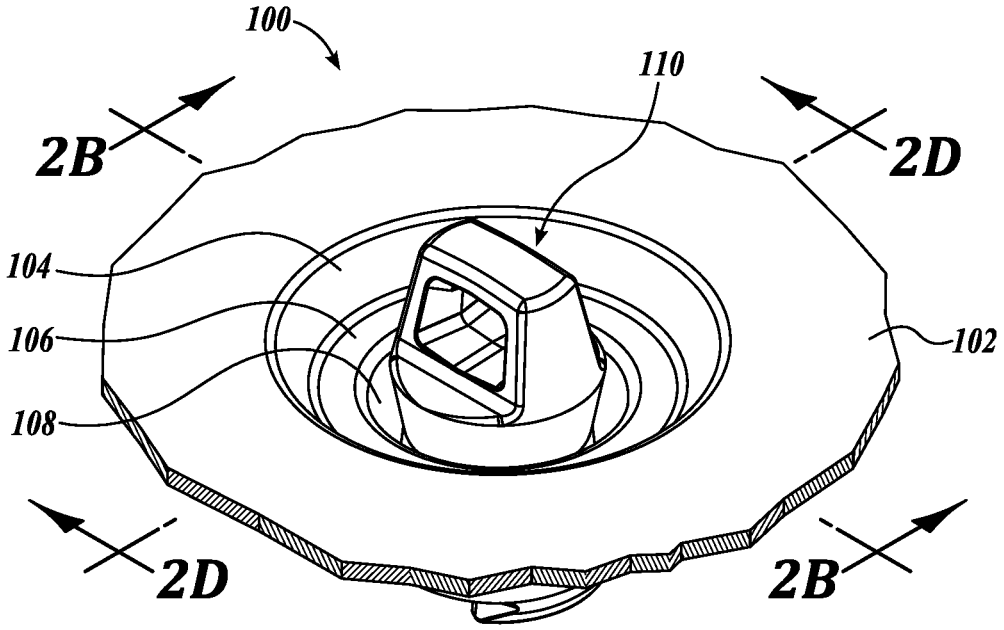
FIG. 1B is a perspective view of the scupper plug and scupper surround assembly of FIG. 1A, with the scupper plug shown in an open position.

FIGS. 1A and 1B depict one example of an assembly 100 having a scupper plug 110 assembled into a scupper hole of a scupper surround 102, such as a scupper hole in a kayak hull, with the assembly 100 shown in perspective view and the scupper plug 110 shown in a closed position in FIG. 1A and an open position in FIG. 1B, in which technologies and/or methodologies of the present disclosure may be employed. The scupper surround 102 can include an upper scupper hole taper 104, a scupper hole shoulder 106, and a primary scupper hole taper 108 that is configured to interface with a primary taper of the scupper plug 110, as will be described in detail below. In the closed position shown in FIG. 1A, the scupper plug 110 is configured to block the flow of water through the scupper hole in the scupper surround 102, and in the open position shown in FIG. 1B, the scupper plug 110 is configured to permit the flow of water through the scupper hole in the scupper surround 102. Although the open position of the scupper plug 110 is generally used to drain water from the upper surfaces of the kayak, water may be permitted to flow upward through the scupper hole, but the position and retention of the scupper plug 110 at least partially blocks the scupper hole, preventing fountains of water spraying upward toward the user, particularly when rougher waters cause pressure differentials between the upper and lower surface of the kayak. Although not shown, from the open position of the scupper plug 110 shown in FIG. 1B, the scupper plug 110 can be further pulled to translate axially and completely disengage with the scupper surround 102 and removed from the kayak.

Figure 2A:
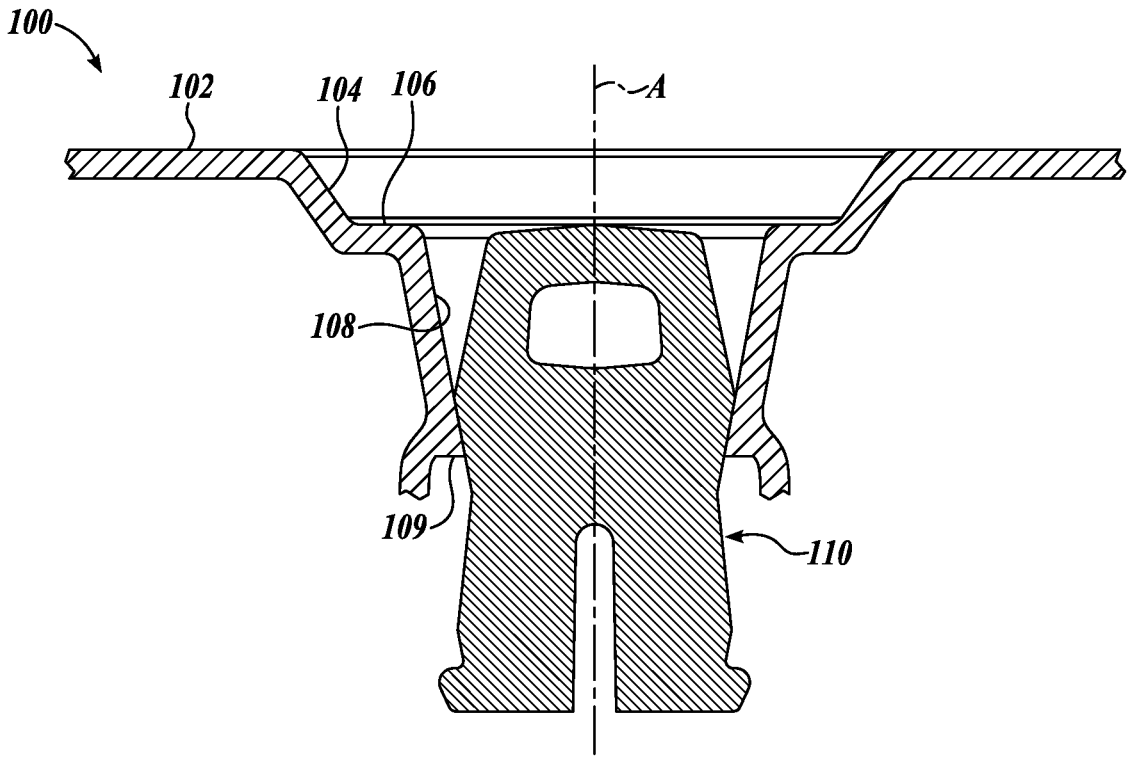
FIG. 2A is a cross-sectional view of the scupper plug and scupper surround assembly of FIG. 1A, taken along the plane 2A-2A shown in FIG. 1A.
Figure 2B:
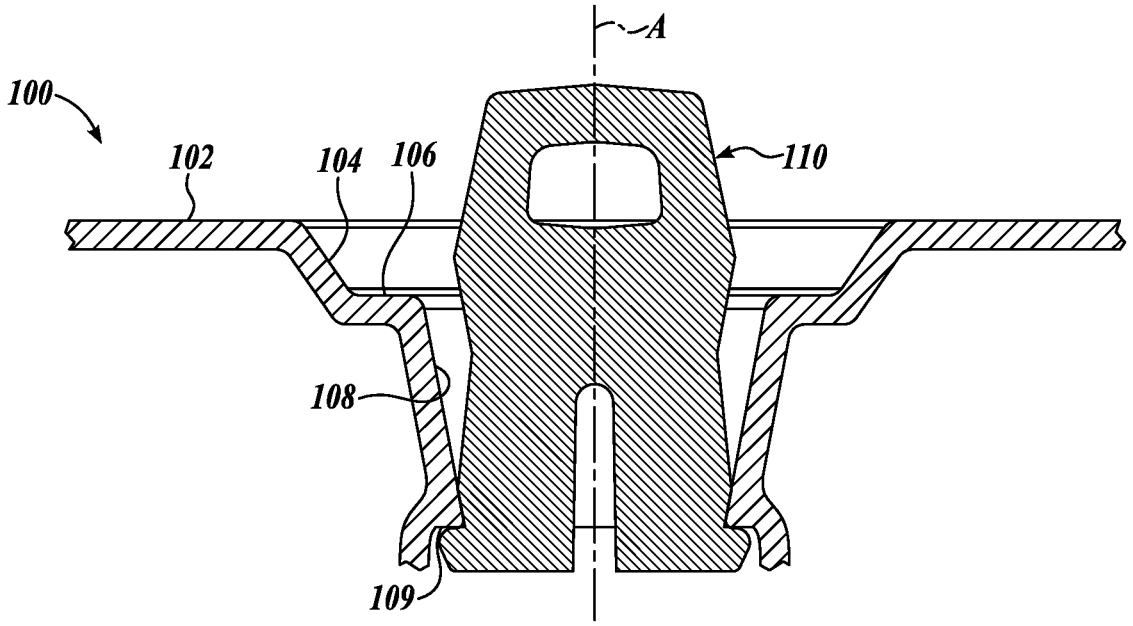
FIG. 2B is a cross-sectional view of the scupper plug and scupper surround assembly of FIG. 1B, taken along the plane 2B-2B shown in FIG. 1B.
Figure 2C:
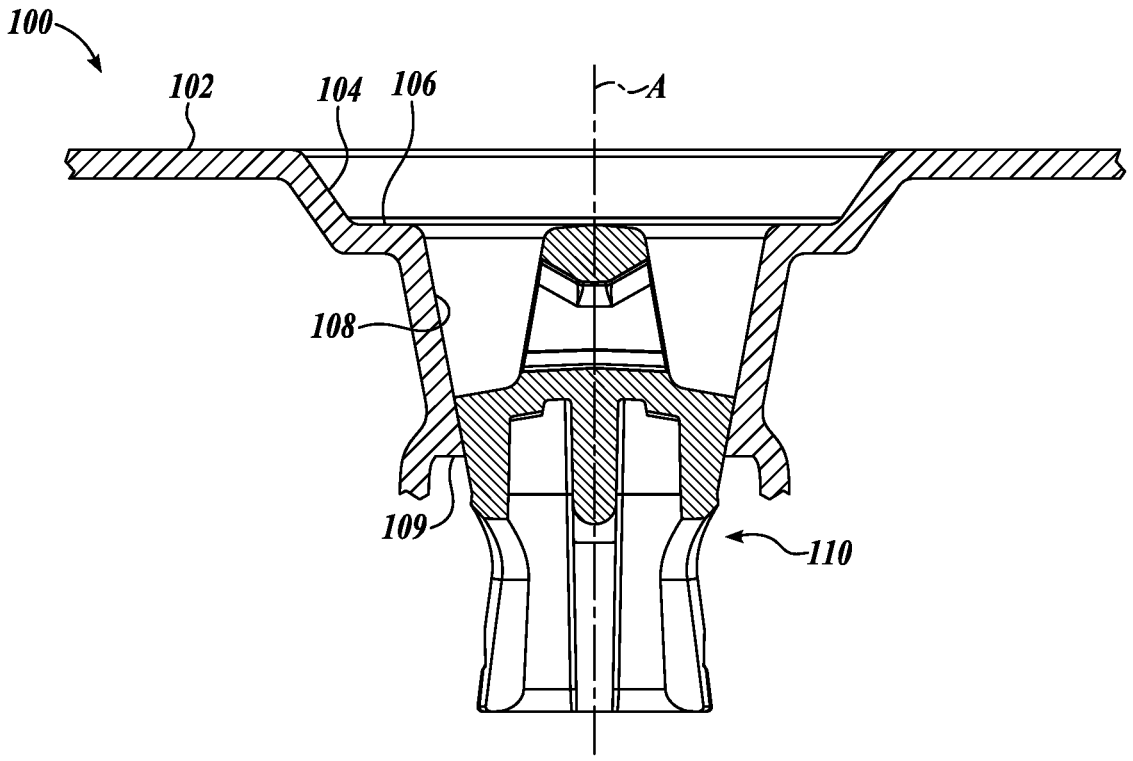
FIG. 2C is a cross-sectional view of the scupper plug and scupper surround assembly of FIG. 1A, taken along the plane 2C-2C shown in FIG. 1A.
Figure 2D:
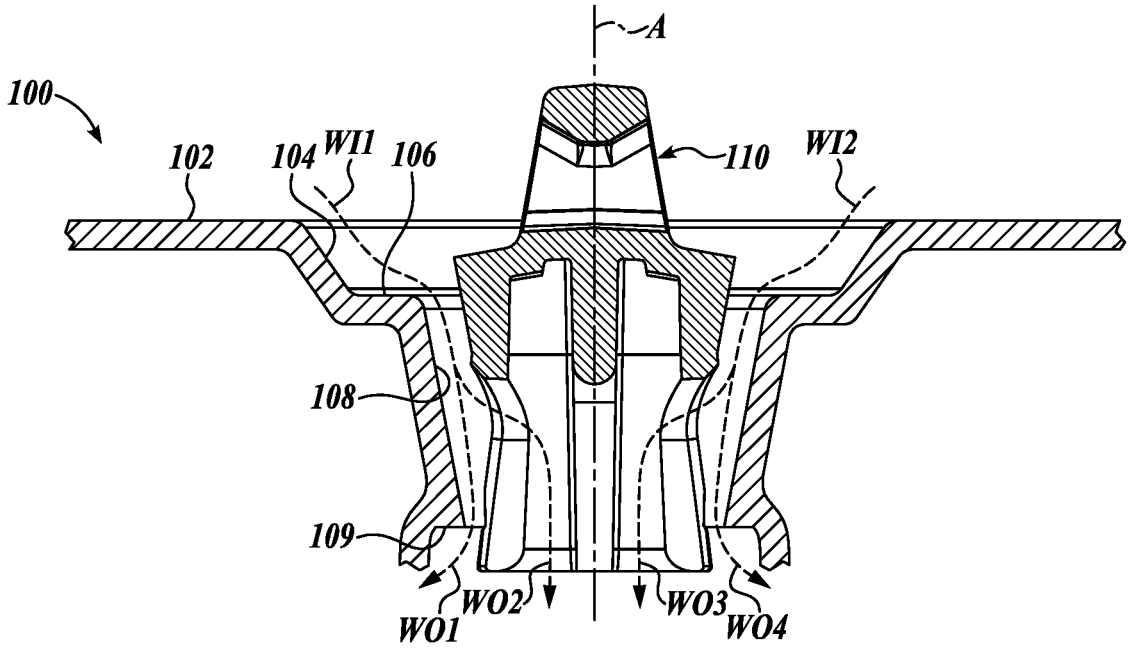
FIG. 2D is a cross-sectional view of the scupper plug and scupper surround assembly of FIG. 1B, taken along the plane 2D-2D shown in FIG. 1B.
Figure 3A:
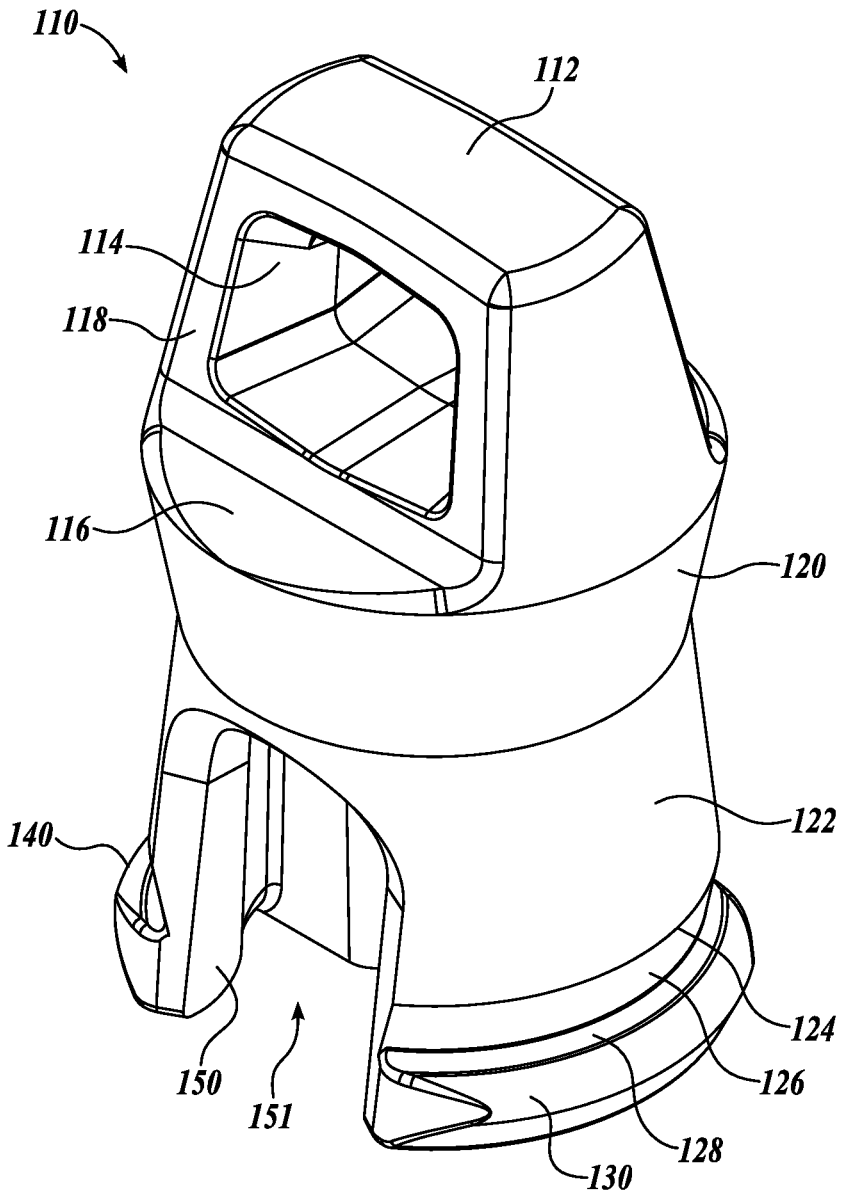
FIG. 3A is a front right top isometric view of a scupper plug formed in accordance with aspects of the present disclosure.
Figure 3B:
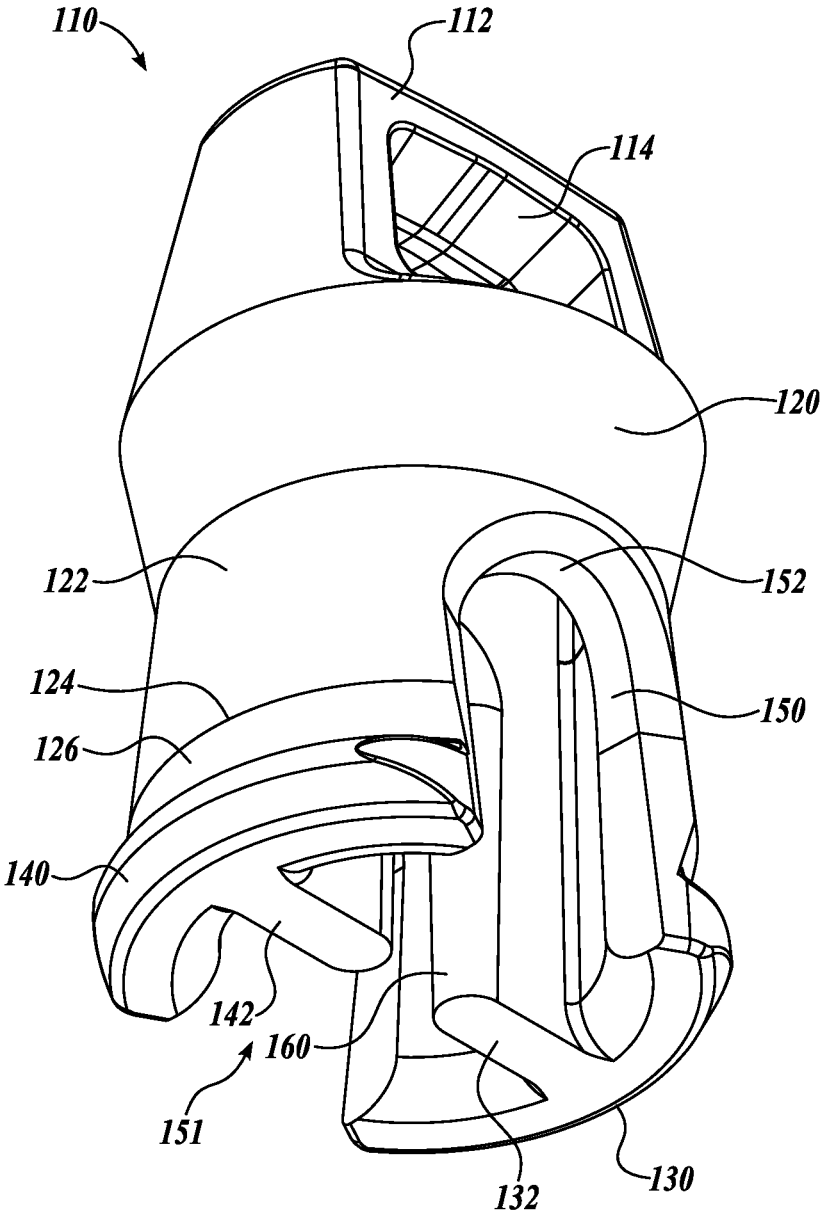
FIG. 3B is a rear right bottom isometric view of the scupper plug of FIG. 3A.
Figure 3C:
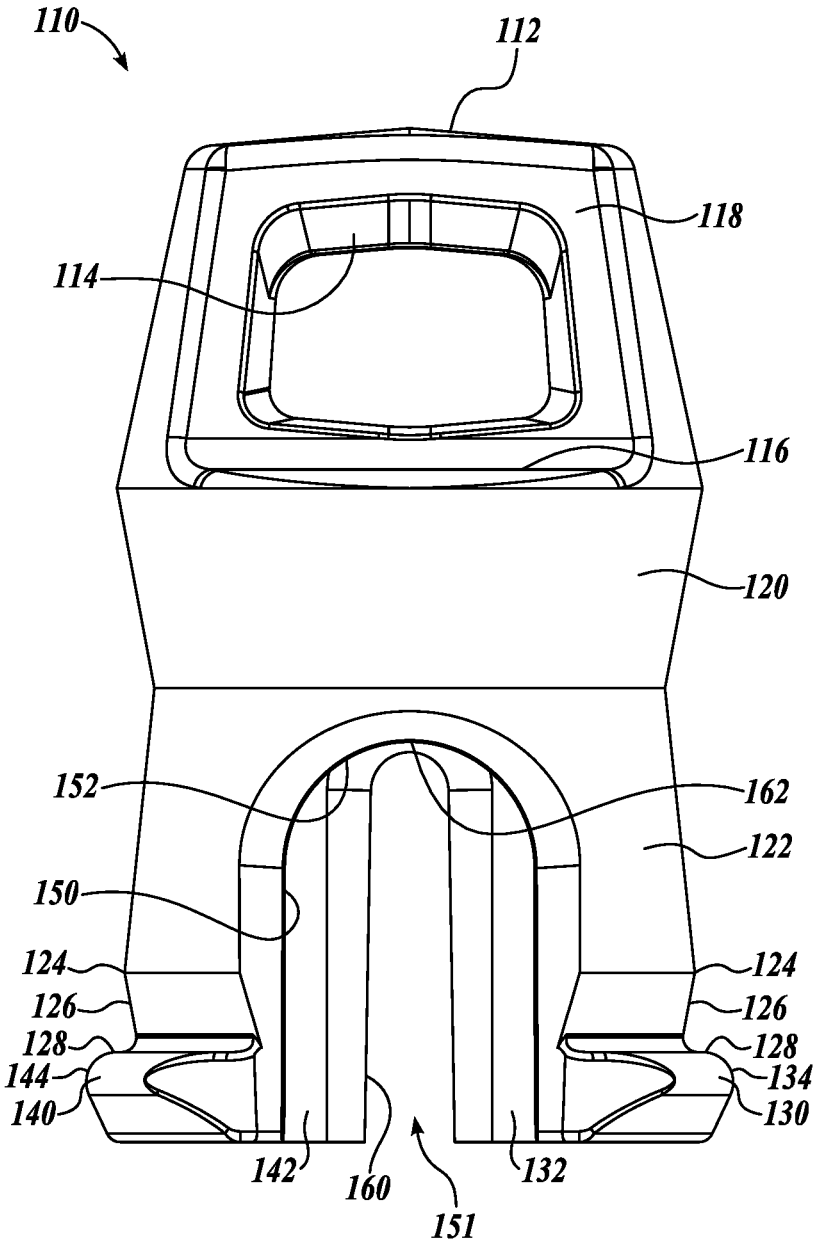
FIG. 3C is a front view of the scupper plug of FIG. 3A.
Figure 3D:
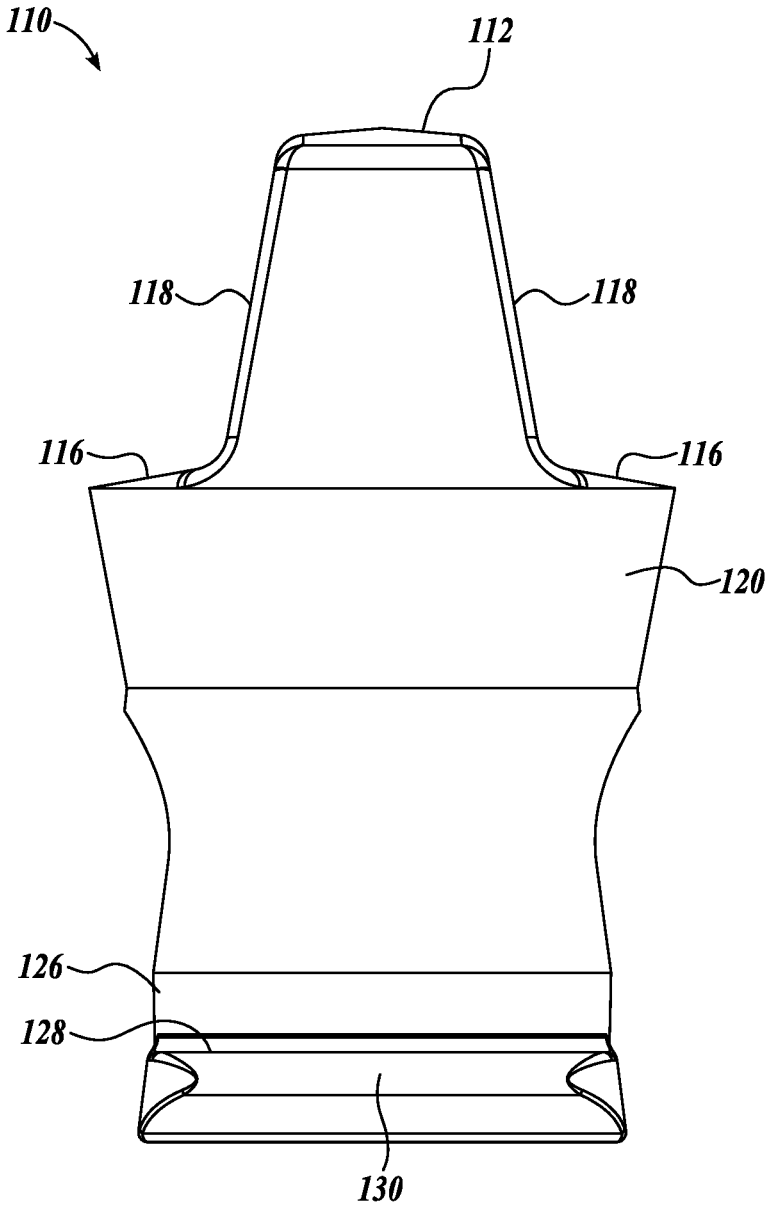
FIG. 3D is a right view of the scupper plug of FIG. 3A.
Figure 3E:
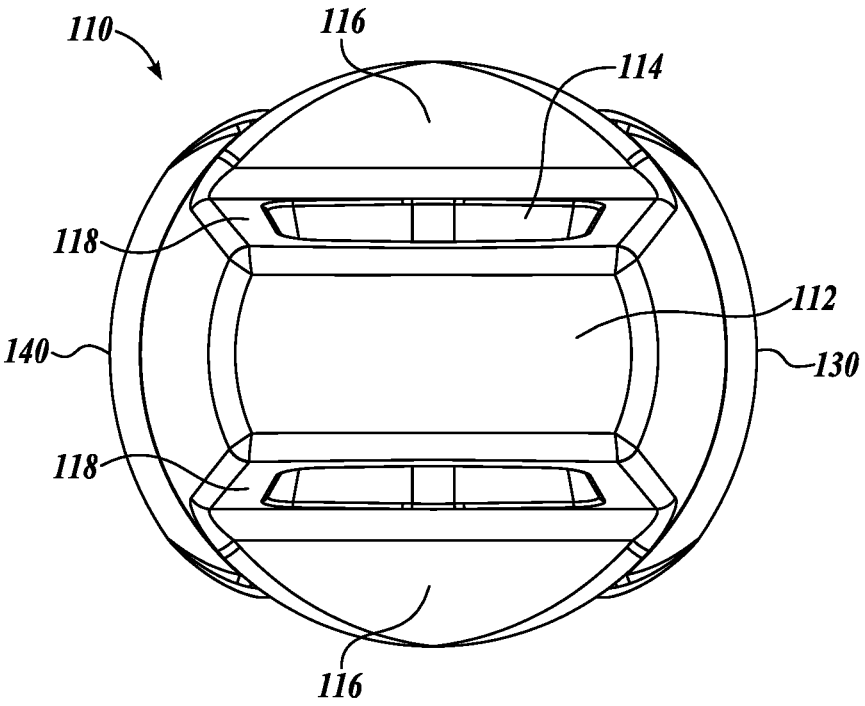
FIG. 3E is a top view of the scupper plug of FIG. 3A.
Figure 3F:
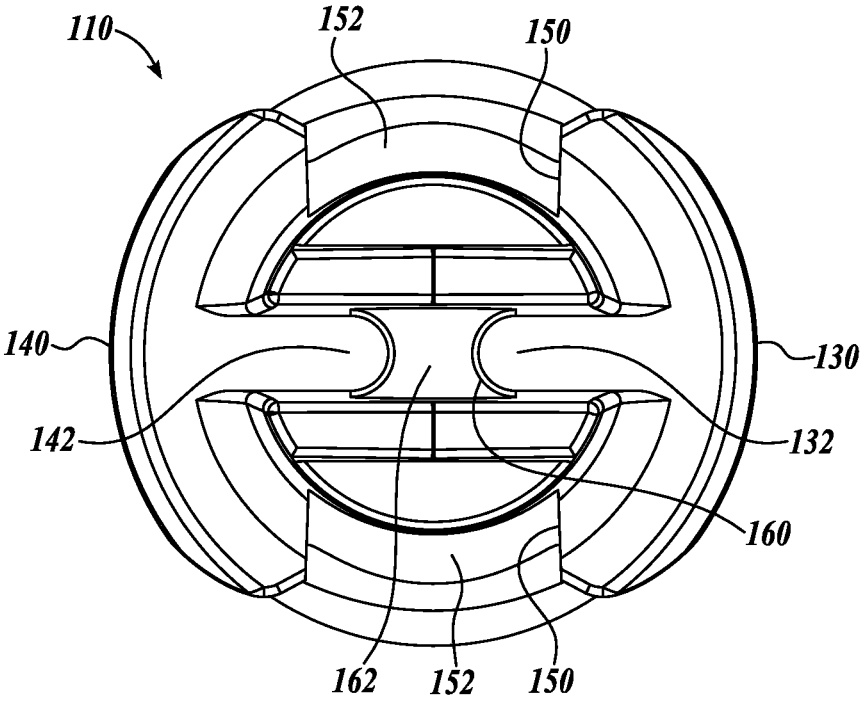
FIG. 3F is a bottom view of the scupper plug of FIG. 3A.

FIGS. 2A-2D are cross-sectional views of the assembly 100, showing the scupper plug 110 and scupper surround 102, with FIG. 2A being taken along plane 2A-2A shown in FIG. 1A, FIG. 2B being taken along plane 2B-2B shown in FIG. 1B, FIG. 2C being taken along plane 2C-2C shown in FIG. 1A, and FIG. 2D being taken along plane 2D-2D shown in FIG. 1B. In this regard, the scupper plug 110 is shown in the closed position in FIGS. 2A and 2C (the cross section planes of which are rotated 90° from each other about a central axis A), and shown in the open position in FIGS. 2B and 2D (the cross section planes of which are rotated 90° from each other about a central axis A). As shown in FIGS. 2A and 2C, in the closed position, the scupper plug 110 is positioned in engagement with the primary scupper hole taper 108 to prevent water flowing through the scupper hole. In a top view, this engagement is substantially 360° around the primary scupper hole taper 108 such that water cannot bypass the scupper plug 110. Although the sealing surface in the scupper hole is shown as the primary scupper hole taper 108 in the illustrated embodiments, in other embodiments the sealing surface that interfaces the scupper plug 110 can be cylindrical, rounded, or otherwise formed to interface with a sealing surface of the scupper plug 110.

Although the shape of the scupper surround 102 is shown with only an upper portion for simplicity in the FIGURES, the scupper surround 102 (and scupper hole) can have any depth with respect to the scupper plug. In these embodiments, the scupper hole can be molded into the kayak with the scupper plug only occupying a portion of the scupper hole when assembled. Further, the upper scupper hole taper 104, the scupper hole shoulder 106, and the shape transitioning into the primary scupper hole taper 108 are shown as one example of a scupper surround suitable for use with the embodiments of the scupper plug 110. For example, the upper scupper hole taper 104 and scupper hold shoulder 106 (e.g., a "scupper well") can be configured to allow user hand clearance to manipulate the scupper plug, retain smaller amounts of water, and/or prevent sharp features on the upper surface of the kayak. In other embodiments, the upper scupper hole taper 104 area can include one or more grooves intended to direct water from various upper surface of the kayak into the scupper well for drainage. In other embodiments, any scupper surround and hole shape can be suitable for use with the scupper plug 110.

As shown in FIGS. 2B and 2D, in the open position, the scupper plug 110 is positioned in partial engagement with the primary scupper hole taper 108 and against an inner scupper hole shoulder 109 to retain the scupper plug 110 in the open position without inadvertent removal of the scupper plug 110, and permit water flowing through the scupper hole. In a top view, this engagement is only partially around the primary scupper hole taper 108 such that water bypasses the scupper plug 110 through one or more cutouts 150 (see FIGS. 3A-3C and 3F) as will be described below. Although the cross-section shown in FIG. 2B does not show a water flow path past the scupper plug 110, turning to FIG. 2D, the flow paths of water through the scupper hole past the scupper plug 110 are shown. As shown, from a first side, a first water inlet WI1 shows a path past the scupper plug 110 with a first water outlet WO1 and a second water outlet WO2, and from a second side, a second water inlet WI2 shows a path past the scupper plug 110 with a third water outlet WO3 and a fourth water outlet WO4. Although the first, second, third, and fourth water outlets WO1, WO2, WO3, and WO4 are fluidly connected in the illustrated embodiments, other embodiments may include features that separate the water outlets, of fewer or greater than four outlets is also within the scope of the present disclosure. Turning to FIGS. 3A-3F, embodiments of the scupper plug 110 will be described in detail. A proximal portion of the scupper plug 110 can include an upper surface 112 partially forming a proximal loop 114 that can be manipulated by the user, e.g., grasped by a user inserting a finger into the proximal loop, to transition the scupper plug 110 from the closed position (e.g., FIG. 2C) to the open position (e.g., FIG. 2D), and/or to remove the scupper plug from the scupper hole by applying a larger pulling force. The upper surface 112 can be configured to receive a pushing force, e.g., by a user pressing on the upper surface 112, to transition the scupper plug 110 from the open position (e.g., FIG. 2D) to the closed position (e.g., FIG. 2C) and/or to install the scupper plug 110 in the scupper hole of the scupper surround 102. Access by the user to the proximal loop 114 can be aided by one or more clearance features in the proximal portion of the scupper plug 110. In the illustrated embodiments, the scupper plug 110 includes an upper clearance area with a clearance shoulder 116 and a clearance upward taper 118 to allow, e.g., a finger of a user to reach the proximal loop 114. Although one possible clearance feature is shown in the FIGURES, any suitable clearance feature can be included in the proximal portion of the scupper plug 110 to permit manipulation of the scupper plug 110 by the user (e.g., to install, remove, and/or transition the scupper plug 110 between the open and closed positions).

The scupper plug 110 includes a primary tapered sealing surface 120 positioned below the proximal portion of the scupper plug 110 (e.g., below the clearance shoulder 116). The primary tapered sealing surface 120 can be circumferentially continuous with respect to the central axis A and be configured to interface with the primary scupper hole taper 108 of the scupper surround 102 such that engagement between the primary tapered sealing surface 120 of the scupper plug 110 and the primary scupper hole taper 108 in the closed position is substantially 360° around the primary scupper hole taper 108 such that water cannot bypass the scupper plug 110. Although the primary scupper hole taper 108 is shown as a complementary tapered surface with respect to the primary tapered sealing surface 120, it will be apparent to one skilled in the art that the primary tapered sealing surface is capable of sealing against a variety of surface shapes in the scupper hole, including a rounded surface, a cylindrical surface, and the like.

The scupper plug 110 can further include an intermediate reverse tapered surface 122 to facilitate transition from the closed position to the open position of the scupper plug 110. The reverse tapered surface 122 can be an opposite taper from the primary tapered sealing surface 120 and can function as a ramp during transition from the closed to open positions as will be described below. The scupper plug further includes a secondary tapered surface 126 at a distal end portion that is configured to interface with the primary scupper hole taper 108 when the scupper plug 110 is in the open position (see, e.g., FIG. 2B). The reverse tapered surface 122 and the secondary tapered surface 126 can be separated by a transition peak 124 where the tapers meet and change direction. The secondary tapered surface 126 can have a stopping shoulder 128 that is configured to abut the inner scupper hole shoulder 109 to stop the axial movement of the scupper plug 110 at the open position without inadvertent removal of the scupper plug 110 from the scupper surround 102. The stopping shoulder 128 can also counteract an upward force created by the interface between the secondary tapered surface 126, the primary scupper hole taper 108, and the radially outward force of the scupper plug legs, as will be described below. It will be appreciated that in use, the scupper plug 110 can be retained in a position that permits water flow through the scupper hole without the stopping shoulder 128 abutting the inner scupper hole shoulder 109 or only partially abutting the inner scupper hole shoulder, such as when the scupper plug 110 is only partially moved toward the open position enough that the secondary tapered surface 126 interfaces the primary scupper hole taper 108, but the stopping shoulder 128 is adjacent to but does not contact or fully contact the inner scupper hole shoulder 109.

The scupper plug 110 can include cutouts through the reverse tapered surface 122, transition peak 124, secondary tapered surface 126, and stopping shoulder 128 to form a first bendable leg 130 and a second bendable leg 140. Although two bendable legs 130 and 140 are shown as created generally by a cutout 150 having a rounded upper area 152 and separated by a central cavity 151, any number of cutouts, any cutout shape, and any form of bendable leg can be used with embodiments of the scupper plug 110. For example, one cutout can form a single bendable leg, while more than two cutouts can form three, four, etc. bendable legs.

The first and second bendable legs 130 and 140 can be configured to translate radially inward toward the central axis A by interaction between the reverse tapered surface 122 and the primary scupper hole taper 108. In this regard, as the scupper plug 110 is transitioned from the closed position (FIG. 2A) toward the open position (FIG. 2B), the transition peak 124 has a larger diameter than the opening of the scupper hole at the primary scupper hole taper 108 adjacent to the inner scupper hole shoulder 109. Accordingly, the first and second bendable legs 130 and 140 translate radially inward toward the central axis A, allowing the transition peak 124 to pass the primary scupper hole taper 108 adjacent to the inner scupper hole shoulder 109, to a position where the bendable legs 130 and 140 translate radially outward away from the central axis A such that the secondary tapered surface 126 interfaces with the primary scupper hole taper 108 and the stopping shoulder 128 abuts the inner scupper hole shoulder 109. In this position, the scupper plug 110 is retained within the scupper hole by the interaction between the shoulder 128 and the inner scupper hole shoulder 109, has an upward force by the outward restorative force in the first and second bendable legs 130 and 140 acting on the secondary tapered surface 126 against the primary scupper hole taper 108. The user can apply a closing force on the upper surface 112 to overcome the upward force of the outward restorative force in the first and second bendable legs 130 and 140 acting on the secondary tapered surface 126 against the primary scupper hole taper 108. This closing force on the upper surface 112 can translate the first and second bendable legs 130 and 140 radially inward toward the central axis A, allowing the transition peak 124 to again pass the primary scupper hole taper 108 adjacent to the inner scupper hole shoulder 109 toward the closed position, where the primary tapered sealing surface 120 interfaces with the primary scupper hole taper 108.

Returning to the open position of the scupper plug 110 shown in FIG. 2B, the scupper plug 110 can be fully removed from the scupper surround (and from the kayak) by continuing to pull the scupper plug 110 upward such that the first and second bendable legs 130 and 140 translate further radially inward toward the central axis A, allowing the radially outermost section of the first and second bendable legs 130 and 140 to pass the primary scupper hole taper 108 adjacent to the inner scupper hole shoulder 109 and the scupper plug 110 be removed from the scupper surround 102. In this regard, the scupper plug can include a first fillet 134 on the outermost section of the first bendable leg 130 and a second fillet 144 on the outermost section of the second bendable leg 140, with the first and second fillets 134 and 144 configured to interface with the inner scupper hole shoulder 109 and assist in translating the first and second bendable legs 130 and 140 radially inward toward the central axis A during full removal of the scupper plug 110. In these embodiments, the axial force required to overcome the interaction of the stopping shoulder 128 and the inner scupper hole shoulder 109 is substantially larger than the axial force required to move the scupper plug 110 from the closed position to the open position, preventing inadvertent removal of the scupper plug 110 while opening the plug.

In some embodiments, the first and second bendable legs 130 and 140 can include inner stiffening ribs 132 and 142, respectively. The stiffening ribs 132 and 142 can be separated by an opening 160 having a rounded transition 162 (see FIGS. 3C and 3F) to permit relative moment of the first and second bendable legs 130 and 140 while the rounded transition prevents tearing or fatigue of the material of the scupper plug 110. In some embodiments, the stiffening ribs 132 and 142 are configured to permit the radially inward bending of the first and second bendable legs 130 and 140, respectively, while providing a restorative force on the first and second bendable legs 130 and 140 urging the legs radially outward and the secondary tapered surface 126 into contact with the primary scupper hole taper 108, retaining the scupper plug 110 in the open position.

The scupper plugs described herein can be formed from any suitable material permitting the deformation of the bendable legs as described above. In some embodiments, the scupper plug 110 can be formed from Thermoplastic Vulcanizates (TPV), Thermoplastic Urethanes (TPU), Thermoplastic Olefins (TPO), Styrenic Block Copolymers (SBC), Copolyester Elastomer (COPE), Polyether Block Amide (PEBA), or similar materials. In other embodiments, multiple materials are used to form the scupper plug 110, e.g., one material at the proximal portion and a different material at the distal portion. Other material configurations are also within the scope of the present disclosure.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 10% of the stated value. For the purposes of the present disclosure, the phrase "at least one of A and B" is equivalent to "A and/or B" or vice versa, namely "A" alone, "B" alone or "A and B.". Similarly, the phrase "at least one of A, B, and C," for example, means (A), (B), (C), (A and B), (A and C), (B and C), or (A, B, and C), including all further possible permutations when greater than three elements are listed.

It should be noted that for purposes of this disclosure, terminology such as "upper," "lower," "vertical," "horizontal," "fore," "aft," "inner," "outer," "front," "rear," etc., should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings.

Throughout this specification, terms of art may be used. These terms are to take on their ordinary meaning in the art from which they come, unless specifically defined herein or the context of their use would clearly suggest otherwise.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A scupper plug for selectively sealing a scupper hole, the scupper plug comprising:

a tapered sealing surface that is circumferentially continuous around a portion configured to interface with a scupper surface of the scupper hole; and a bendable leg extending from the tapered sealing surface, the bendable leg having:

a secondary tapered surface positioned at a distal end portion of the bendable leg;

a stopping shoulder at a distal end of the secondary tapered surface and configured to abut a shoulder portion of the scupper hole; and a cutout extending through the bendable leg at the secondary tapered surface, the cutout being positioned along at least a portion of a circumference of the secondary tapered surface, wherein:

when in a closed position, the tapered sealing surface is positioned to sealingly contact the scupper surface to prevent water flow through the scupper hole past the scupper plug; and when in an open position, the secondary tapered surface is positioned to contact the scupper surface and the stopping shoulder is positioned to abut the shoulder portion of the scupper hole, the secondary tapered surface and the stopping shoulder together retaining the scupper plug in the open position to permit water flow through the scupper hole by permitting water flow through the cutout.

2. The scupper plug of claim 1, wherein the bendable leg is a first bendable leg and the cutout is a first cutout, and wherein the scupper plug further comprises a second bendable leg extending from the tapered sealing surface, the second bendable leg having:

a secondary tapered surface positioned at a distal end portion of the second bendable leg;

a stopping shoulder at a distal end of the secondary tapered surface and configured to abut the shoulder portion of the scupper hole; and a second cutout extending through the respective secondary tapered surfaces of the first and second bendable legs, the first and second cutouts being positioned opposite each other separating the first bendable leg from the second bendable leg, wherein when in the open position, the secondary tapered surfaces of the first and second bendable legs are positioned to contact the scupper surface and the stopping shoulders of the first and second bendable legs are positioned to abut the shoulder portion of the scupper hole, the secondary tapered surfaces and the stopping shoulders of the first and second bendable legs together retaining the scupper plug in the open position to permit water flow through the first and second cutouts past the scupper plug.

3. The scupper plug of claim 1, wherein the secondary tapered surface has a taper direction that is the same as a taper direction of the tapered sealing surface.

4. The scupper plug of claim 1, wherein the bendable leg further comprises a transition surface extending between the tapered sealing surface and the secondary tapered surface, wherein the transition surface is configured to urge the bendable leg radially inward as the scupper plug is moved from the closed position toward the open position.

5. The scupper plug of claim 4, wherein the transition surface is a reverse taper with respect to the tapered sealing surface.

6. The scupper plug of claim 4, wherein the transition surface and the secondary tapered surface are reverse tapers with respect to each other, and wherein a transition peak separates the transition surface and the secondary tapered surface.

7. The scupper plug of claim 4, wherein the bendable leg has a radially outward restorative force urging the bendable leg against the scupper surface when the scupper plug is in the open position.

8. The scupper plug of claim 1, wherein the bendable leg further includes a stiffening rib projecting radially inward from the bendable leg toward a central axis of the scupper plug, wherein the stiffening rib is configured to bias the bendable leg radially outward when the scupper plug is in the open position.

9. The scupper plug of claim 1, further comprising a proximal loop extending upward from the tapered sealing surface, the proximal loop having an aperture configured to interface with a user during movement of the scupper plug between the open and closed positions.

10. The scupper plug of claim 9, wherein the proximal loop has clearance area radially outward from the proximal loop, wherein the clearance area is configured to permit user interface with the proximal loop during movement of the scupper plug between the open and closed positions.

11. A scupper plug for selectively sealing a scupper hole, the scupper plug comprising:

a tapered sealing surface that is circumferentially continuous;

a first leg extending from the tapered sealing surface, the first leg having;

a first tapered retention surface positioned at a distal portion of the first leg; and a first stopping shoulder adjacent to the first tapered retention surface and configured to abut a shoulder portion of the scupper hole;

a second leg extending from the tapered sealing surface, the second leg having:

a second tapered retention surface positioned at a distal portion of the second leg; and a second stopping shoulder adjacent to the second tapered retention surface and configured to abut the shoulder portion of the scupper hole; and a central cavity extending between the first and second legs, the central cavity and the first and second legs defining first and second cutouts extending through the first and second legs adjacent to the first and second tapered retention surfaces, wherein:

when in a closed position, the tapered sealing surface is positioned to sealingly contact a scupper surface in the scupper hole to prevent water flow through the scupper hole past the scupper plug; and when in an open position, the first and second tapered retention surfaces are positioned to contact the scupper surface and the first and second stopping shoulders are positioned to abut the shoulder portion of the scupper hole, the first and second tapered retention surfaces and stopping shoulders together retaining the scupper plug in the open position to permit water flow through the scupper hole by water flowing through the first and second cutouts past the scupper plug.

12. The scupper plug of claim 11, wherein the first and second tapered retention surfaces have taper directions that are the same as a taper direction of the tapered sealing surface.

13. The scupper plug of claim 11, wherein the first and second legs each further comprises a transition surface extending between the tapered sealing surface and the respective first and second tapered retention surfaces, wherein the transition surfaces are configured to urge the first and second legs radially inward as the scupper plug is moved from the closed position toward the open position.

14. The scupper plug of claim 13, wherein the transition surfaces have a reverse taper with respect to the tapered sealing surface.

15. The scupper plug of claim 13, wherein the transition surfaces and the respective first and second tapered retention surfaces are reverse tapers with respect to each other, and wherein a transition peak separates the transition surfaces and the respective first and second tapered retention surfaces.

16. The scupper plug of claim 13, wherein the first and second legs have a radially outward restorative force urging the first and second legs against the scupper surface when the scupper plug is in the open position.

17. The scupper plug of claim 11, wherein the first and second legs each further comprise a stiffening rib projecting radially inward from the respective first and second legs toward a central axis of the scupper plug, wherein the stiffening ribs are configured to bias the respective first and second legs radially outward when the scupper plug is in the open position.

18. The scupper plug of claim 11, further comprising a proximal loop extending upward from the tapered sealing surface, the proximal loop having an aperture configured to interface with a user during movement of the scupper plug between the open and closed positions.

19. The scupper plug of claim 18, wherein the proximal loop has clearance area radially outward from the proximal loop, wherein the clearance area is configured to permit user interface with the proximal loop during movement of the scupper plug between the open and closed positions.

20. The scupper plug of claim 11, wherein the first and second stopping shoulders further include a fillet surface configured to interface with the shoulder portion of the scupper hole to urge the first and second legs radially inward as the scupper plug is moved from the open position to full removal from the scupper hole.

21. The scupper plug of claim 11, wherein the scupper plug is made from Thermoplastic Vulcanizates (TPV), Thermoplastic Urethanes (TPU), Thermoplastic Olefins (TPO), Styrenic Block Copolymers (SBC), Copolyester Elastomer (COPE), Polyether Block Amide (PEBA), or a combination thereof.

* * * * *